US007780169B2

(12) United States Patent
Breslo

(10) Patent No.: US 7,780,169 B2
(45) Date of Patent: Aug. 24, 2010

(54) PULL-TAB POKER GAME AND PULL-TAB POKER GAME WAGERING SYSTEM

(75) Inventor: James Breslo, Torrance, CA (US)

(73) Assignee: Diamond Game Enterprises, Inc., Chatsworth, CA (US)

( * ) Notice: Subject to any disclaimer, the term of this patent is extended or adjusted under 35 U.S.C. 154(b) by 996 days.

(21) Appl. No.: 10/996,716

(22) Filed: Nov. 24, 2004

(65) Prior Publication Data

US 2006/0111167 A1 May 25, 2006

(51) Int. Cl.

| | |
|---|---|
| ***A63F 3/06*** | (2006.01) |
| ***A63F 1/00*** | (2006.01) |
| ***A63F 13/10*** | (2006.01) |
| ***A63F 13/02*** | (2006.01) |

(52) U.S. Cl. ..... 273/269; 273/292; 463/13; 463/16; 463/17; 463/25

(58) Field of Classification Search ..... 273/292, 273/269, 273; 463/10–13, 17–22, 16, 30, 463/31, 25; 283/48.1, 49, 903
See application file for complete search history.

(56) References Cited

U.S. PATENT DOCUMENTS

| | | | | |
|---|---|---|---|---|
| 1,527,929 | A * | 2/1925 | Simons | 273/139 |
| 3,667,757 | A | 6/1972 | Holmberg | |
| 4,760,527 | A * | 7/1988 | Sidley | 463/13 |
| 4,836,553 | A | 6/1989 | Suttle et al. | |
| 4,861,041 | A | 8/1989 | Jones et al. | |
| 5,083,272 | A * | 1/1992 | Walker et al. | 463/25 |
| 5,092,598 | A * | 3/1992 | Kamille | 273/139 |
| 5,098,107 | A | 3/1992 | Boylan et al. | |
| 5,100,137 | A | 3/1992 | Fulton | |
| 5,118,109 | A * | 6/1992 | Gumina | 273/139 |
| 5,154,429 | A | 10/1992 | LeVasseur | |
| 5,167,413 | A | 12/1992 | Fulton | |

(Continued)

FOREIGN PATENT DOCUMENTS

| | | |
|---|---|---|
| WO | WO 94/19074 | 9/1994 |

OTHER PUBLICATIONS

"Scarne's Encyclopedia of Card Games," by John Scarne, 1973, HarperCollins, New York, NY, chapters on poker.*

(Continued)

*Primary Examiner*—Peter DungBa Vo
*Assistant Examiner*—Matthew D. Hoel
(74) *Attorney, Agent, or Firm*—Panitch Schwarze Belisario & Nadel LLP

(57) ABSTRACT

A pull-tab poker variant card game includes at least one ticket having images of playing cards selected from a conventional deck of cards. Each of the card images on the ticket has a face suit and an associated face value. The rules include each player placing an original wager before any card images are revealed; giving the player an opportunity to increase the wager by a first amount after revealing three card images; giving the player an opportunity to increase the wager by a second amount after revealing a first hole card image; revealing a second hole card image; and paying a player having a winning hand for the total wager including the original wager and the first and second amounts based upon a predetermined payout table that indicates what hands are winning hands.

22 Claims, 6 Drawing Sheets

P

PAYOUT TABLE

| PLAYERS WINNING HAND | PAYOUT RATIO |
|---|---|
| ROYAL FLUSH | 1000 TO 1 |
| STRAIGHT FLUSH | 200 TO 1 |
| FOUR OF A KIND | 50 TO 1 |
| FULL HOUSE | 11 TO 1 |
| FLUSH | 8 TO 1 |
| STRAIGHT | 5 TO 1 |
| THREE OF A KIND | 3 TO 1 |
| TWO PAIR | 2 TO 1 |
| TENS OR BETTER | 1 TO 1 |

U.S. PATENT DOCUMENTS 5,242,163 A 9/1993 Fulton
5,251,897 A 10/1993 Fulton
5,288,081 A 2/1994 Breeding
5,322,295 A 6/1994 Cabot et al.
5,324,035 A * 6/1994 Morris et al. ..... 463/42
5,348,299 A 9/1994 Clapper, Jr.
5,407,199 A * 4/1995 Gumina ..... 273/139
5,411,257 A 5/1995 Fulton
5,417,430 A 5/1995 Breeding
5,437,451 A 8/1995 Fulton
5,437,462 A 8/1995 Breeding
5,544,892 A 8/1996 Breeding
5,636,842 A 6/1997 Cabot et al.
5,679,077 A * 10/1997 Pocock et al. ..... 463/19
5,718,430 A * 2/1998 Aramapakul et al. ..... 273/292
5,820,460 A 10/1998 Fulton
5,855,514 A * 1/1999 Kamille ..... 463/17
5,901,958 A * 5/1999 Andrews ..... 273/292
5,921,550 A 7/1999 Awada
5,931,467 A * 8/1999 Kamille ..... 273/139
5,941,771 A 8/1999 Haste, III
5,975,529 A 11/1999 de Keller
5,988,643 A 11/1999 Awada
5,996,997 A * 12/1999 Kamille ..... 273/139
6,019,374 A 2/2000 Breeding
6,102,400 A 8/2000 Scott et al.
6,102,402 A 8/2000 Scott et al.
6,132,311 A 10/2000 Williams
6,206,780 B1 3/2001 Awada
6,224,055 B1 * 5/2001 Walker et al. ..... 273/139
6,237,913 B1 * 5/2001 Kamille ..... 273/139
6,250,685 B1 * 6/2001 Walker et al. ..... 283/49
6,273,424 B1 8/2001 Breeding
6,280,325 B1 * 8/2001 Fisk ..... 463/19
6,299,534 B1 10/2001 Breeding et al.
6,311,979 B1 11/2001 Andrews
6,379,245 B2 4/2002 De Keller
6,435,500 B2 * 8/2002 Gumina ..... 273/139
6,467,771 B1 10/2002 de Keller
6,478,675 B1 11/2002 Awada
6,527,175 B1 * 3/2003 Dietz et al. ..... 235/381
6,572,107 B1 * 6/2003 Walker et al. ..... 273/139
6,705,943 B2 3/2004 Awada
6,746,328 B2 6/2004 Cannon et al.
6,790,141 B2 9/2004 Muir
6,796,904 B2 9/2004 Yoseloff
2001/0019193 A1 * 9/2001 Gumina ..... 273/139
2001/0029487 A1 * 10/2001 Kwon ..... 705/41
2002/0008356 A1 1/2002 de Keller
2002/0147047 A1 * 10/2002 Letovsky et al. ..... 463/42
2003/0003985 A1 * 1/2003 Han ..... 463/17
2003/0193136 A1 * 10/2003 Walker et al. ..... 273/139
2004/0009799 A1 1/2004 Breeding et al.
2004/0036217 A1 2/2004 Schlumbrecht
2006/0040722 A1 * 2/2006 Manz ..... 463/16

OTHER PUBLICATIONS

Let-It-Ride™ Poker, printout from website: www.worktheodds.com/university/letitride.php printout date: Jan. 6, 2005, initial posting date is unknown (4 pages).
Rules of Let It Ride, printout from website: www.casinocity.com/rule/letitr.htm, printout date: Jan. 6, 2005, initial posting date is unknown (2 pages).
Gambling il dado, printout from website www.ildado.com/let_it _ ride _poker.html, printout date Jun. 14, 2004, initial posting date is unknown (3 pages).
Texas Hold'em Rules and Basic Strategy, printout from website www.texasholdem.omnihosts.net/, printout date Oct. 25, 2004, initial posting date is unknown (8 pages).
Robison, J., Expert Strategy for Double Down Stud Video Poker, Dec. 13, 2001, casinocitytimes.com (4 pages).
Dancer, B., Double Down Stud Returns With A Bang, Jan. 2003, Strictly Slots (3 pages).

* cited by examiner

P

PAYOUT TABLE

| PLAYERS WINNING HAND | PAYOUT RATIO |
|---|---|
| ROYAL FLUSH | 1000 TO 1 |
| STRAIGHT FLUSH | 200 TO 1 |
| FOUR OF A KIND | 50 TO 1 |
| FULL HOUSE | 11 TO 1 |
| FLUSH | 8 TO 1 |
| STRAIGHT | 5 TO 1 |
| THREE OF A KIND | 3 TO 1 |
| TWO PAIR | 2 TO 1 |
| TENS OR BETTER | 1 TO 1 |

FIG. 6

PULL-TAB POKER GAME AND PULL-TAB POKER GAME WAGERING SYSTEM

BACKGROUND OF THE INVENTION

The present invention relates generally to a card game and method of playing a card game, and more particularly, to a poker game including a wagering scheme therefor.

A card game known as "Let-It-Ride® Poker" is disclosed in, for example, U.S. Pat. No. 5,288,081 (Breeding). Let-It-Ride Poker is available from Shuffle Master, Inc., Las Vegas Nev. Breeding encompasses a family of patents and continuations related to the Let-It-Ride concept including U.S. Pat. Nos. 5,417,430; 5,437,462; 6,273,424; 5,544,892; 6,019,374; 6,299,534; and U.S. Patent Application Publication No. 2004/0009799. Multiple-action wagering card games are disclosed in, for example, U.S. Pat. No. 5,154,429 (LeVasseur).

The concept of Let-It-Ride Poker is to make a winning poker hand, usually a pair of tens or better, from a player's three-card hand plus two hole-cards. The composite five-card hand is dealt with no redraw. Once all cards are revealed, whatever wagers that are remaining on the table are paid according to a predetermined payout table that indicates what hands are winning hands. Let-It-Ride is played on a table very similar to blackjack, but instead of blackjack's one wagering circle per hand, Let-It-Ride has three wagering circles. Before the cards are dealt, each player must place an equal wager in each circle. After wagers are placed, each player is dealt three cards face down and two hole-cards are also dealt face down in front of the dealer. Players must wait for the dealer's signal before they pick up their cards. Players are then allowed to use only one hand to look at their cards and it is not permitted to look at any other player's hands. The game starts with the player to the dealer's left. After a player looks at their own three-card hand, they have the option to either take down their first wager or to Let-It-Ride. If a player wishes to let the first wager ride, the player slides their cards face down under the wager in the first circle or simply tells the dealer to Let-It-Ride. After all the players have made a decision on their first wager, the dealer turns over the first hole-card. This first hole-card represents a fourth card for each player's own hand. Based upon this fourth card, each player then decides whether to take down the second wager or to similarly Let-It-Ride. Again, once all the players have made their decision regarding the second wager, the dealer then turns over the second hole-card which, in similar fashion, becomes the fifth card in each player's hand. If any player has a poker hand of a pair of tens or better, all the remaining wagers are paid according to a payout table that indicates what hands are winning hands. Players without paying hands lose whatever wagers still remain in play. The payout table includes a pair of tens or better, three of a kind, a straight, a flush, a full house, four of a kind, a straight flush and a royal flush. The payout scheme in the payout table is usually progressively increased from a pair of tens through a royal flush. The Let-It-Ride game also includes a side wager for each hand where a player can wager, for example, a dollar and win a bonus payout for certain combinations of hands in addition to the payout table with respect to the hand of poker.

Additionally, there are many different types of game tickets known in the art. One conventional type of game ticket is associated with a pull-tab (pull-tab) game. In a pull-tab game, a set of game tickets, often referred to as a "deal of tabs" are created. There are a fixed amount of wins in each deal. The type and amount of wins are used to create the content of the pull-tab tickets. A typical pull-tab ticket has multiple tabs ("windows") per game ticket that are initially hidden. Upon purchase, a player uncovers each of the pull-tabs to reveal images underneath the tabs to determine if the ticket is a winner. A winning pull-tab ticket may require the presence of a combination of symbols (similar to a slot machine), or the presence of a winning symbol under a single pull-tab. Machines have been created to automatically dispense and even validate pull-tabs. See, for example, U.S. Pat. No. 5,941,771 (Haste, III) and U.S. Pat. No. 5,348,299 (Clapper, Jr.). One commercially sold pull-tab machine is the Lucky Tab II machine, available from Diamond Game Enterprises, Inc., Chatsworth, Calif.

Electronic pull-tab machines also exist. These machines are electronically loaded with one or more electronic "digital deals" (i.e., an electronic version of a set of physical tickets). Unlike a lottery terminal or slot machine, the electronic pull-tab machine does not select the outcome; the pull-tab machine merely dispenses the set of tickets which have predetermined content that provides a predetermined outcome. The electronic pull-tabs are dispensed in a previously determined order, such as sequentially. A touch screen is often provided on such machines. Upon receipt of payment, a pull-tab appears on the touch screen and the player touches each tab or window to reveal its hidden content. A receipt is printed if the pull-tab is a winner. When all of the pull-tabs in each available deal are sold, new digital deals must be electronically loaded into the machine to allow for continued play. One example of a touch screen electronic pull-tab machine that dispenses "digital pull-tabs" is commercially available from Tekbilt USA, Huntingdon Valley, Pa. The digital deal is loaded into the Tekbilt USA machine using a floppy disk and security key.

It is desirable to provide a poker variant card game having push-up wagering (i.e., increasing a wager or increasing each of a plurality of wagers) instead of withdraw wagering. More particularly, in lieu of giving the option of withdrawing a wager after cards are dealt and/or after a hole-card is turned over, at each step the player is instead given the option to increase their preexisting wager, such as being able to double one of a plurality of wagers after some event takes place. Further, it is desirable to provide a pull-tap poker variant card game with push-up or increase wagering. Even further, it is desirable to provide an electronic poker variant card game with push-up or increase wagering.

BRIEF SUMMARY OF THE INVENTION

Briefly stated, the present invention comprises a poker variant card game including one or more conventional decks of cards and a set of rules for the card game. Each of the one or more conventional decks of cards has a plurality of individual playing cards. Each of the individual playing cards has a back, a face, a face suit including one of Hearts, Diamonds, Clubs and Spades, and an associated face value including one of Ace, two, three, four, five, six, seven, eight, nine, ten, Jack, Queen and King. The rules include each player placing an original wager before any cards are dealt; dealing three cards to each player face down and two hole-cards face down; giving each player the opportunity to increase their wager by a first amount after they look at their first three cards before any hole-cards are revealed; revealing the first hole-card and giving each player an opportunity to increase their wager by a second amount; revealing the second hole-card; and paying each player having a winning hand for their total respective wager including their respective original wager and their respective first and second amount, if applicable, based upon a predetermined payout table that indicates what hands are winning hands.

In another aspect, the rules include each player placing an original wager before any cards are dealt; dealing two cards to each player face down and five hole-cards face down; giving each player the opportunity to increase their wager by a first amount after they look at their first two cards before any hole-cards are revealed; revealing first, second and third hole-cards and giving each player an opportunity to increase their wager by a second amount; revealing a fourth hole-card and giving each player an opportunity to increase their wager by a third amount; revealing a fifth hole-card; and paying each player having a winning hand for their total respective wager including their respective original wager and their respective first, second and third amounts, if applicable, based upon a predetermined payout table that indicates what hands are winning hands.

In another aspect, the rules include each player placing first and second wagers before any cards are dealt; dealing three cards to each player face down and two hole-cards face down; giving each player the opportunity to increase their first wager by a first amount after they look at their first three cards before any hole-cards are revealed; revealing the first hole-card and giving each player an opportunity to increase their second wager by a second amount; revealing the second hole-card; and paying each player having a winning hand for all of their respective wagers including their respective first and second wagers and their respective first and second amount, if applicable, based upon a predetermined payout table that indicates what hands are winning hands.

In another aspect, the rules include each player placing an original wager before any cards are dealt; dealing five cards to each player face down; giving each player the opportunity to increase their wager by a first amount after they look at their first five cards; if the player increases their wager by the first amount, dealing the respective player a sixth card and giving that player an opportunity to increase their wager by a second amount after they look at their sixth card; if the player increases their wager by the second amount, dealing the respective player a seventh card; and paying each player having a winning hand for their total respective wager including their respective original wager and their respective first and second amounts, if applicable, based upon a predetermined payout table that indicates what hands are winning hands.

The present invention also comprises a pull-tab poker variant card game including a pull-tab ticket and a set of rules for the card game. The pull-tab ticket has five tabs covering five images of playing cards selected from a conventional deck of cards. The conventional deck of cards has a plurality of individual playing cards. Each of the individual playing cards has a face suit including one of Hearts, Diamonds, Clubs and Spades, and an associated face value including one of Ace, two, three, four, five, six, seven, eight, nine, ten, Jack, Queen and King. The rules include placing an original wager before any card images are revealed on the at least one ticket; revealing three card images to the player and not revealing two hole-card images; giving the player the opportunity to increase their wager by a first amount after they look at their first three card images before any hole-card images are revealed; revealing the first hole-card image and giving the player an opportunity to increase their wager by a second amount; revealing the second hole-card image; and paying a player having a winning hand for the total wager including the original wager and the first and second amounts, if applicable, based upon a predetermined payout table that indicates what hands are winning hands.

In yet another aspect, the present invention is a pull-tab poker variant card game including a different set of rules for the card game. The rules include placing an original wager before any card images are revealed on the at least one ticket; revealing two card images to the player and not revealing three hole-card images; giving the player the opportunity to increase their wager by a first amount after they look at their first two card images before any hole-card images are revealed; revealing a first hole-card image and giving the player an opportunity to increase their wager by a second amount; revealing a second hole-card image and giving the player an opportunity to increase their wager by a third amount; revealing a third hole-card image; and paying a player having a winning hand for the total wager including the original wager and the first, second and third amounts, if applicable, based upon a predetermined payout table that indicates what hands are winning hands.

In yet another aspect, the present invention is a pull-tab poker variant card game including a different set of rules for the card game. The rules include placing an original wager before any card images are revealed on the at least one ticket; revealing four card images to the player and not revealing a hole-card image; giving the player the opportunity to increase their wager by a first amount after they look at their first four card images before the hole-card image is revealed; revealing the hole-card image; and paying a player having a winning hand for the total wager including the original wager and the first amount, if applicable, based upon a predetermined payout table that indicates what hands are winning hands.

In yet another aspect, the present invention is a pull-tab poker variant card game including at least one ticket having seven images of playing cards selected from a conventional deck of cards and a set of rules for the card game. The rules include placing an original wager before any card images are revealed on the at least one ticket; revealing two card images and not revealing five hole-card images; giving each player the opportunity to increase their wager by a first amount after they look at their first two card images before any hole-card images are revealed; revealing first, second and third hole-card images and giving each player an opportunity to increase their wager by a second amount; revealing a fourth hole-card image and giving each player an opportunity to increase their wager by a third amount; revealing a fifth hole-card image; and paying each player having a winning hand for their total respective wager including their respective original wager and their respective first, second and third amounts, if applicable, based upon a predetermined payout table that indicates what hands are winning hands.

In yet another aspect, the present invention is a pull-tab poker variant card game including at least one ticket having seven images of playing cards selected from a conventional deck of cards and a set of rules for the card game. The rules include placing an original wager before any card images are revealed on the at least one ticket; revealing five card images to the player; giving the player the opportunity to increase their wager by a first amount after they look at their first five card images; if the player increases their wager by the first amount, revealing a sixth card image and giving that player an opportunity to increase their wager by a second amount after they look at their sixth card image; if the player increases their wager by the second amount, revealing a seventh card image; and paying a player having a winning hand for the total wager including the original wager and the first and second amounts, if applicable, based upon a predetermined payout table that indicates what hands are winning hands.

In yet another aspect, the present invention comprises a gaming machine for playing pull-tab poker variant card game that includes a video display, an input device that receives player input and at least one ticket having five images of playing cards selected from a conventional deck of cards. The conventional deck of cards have a plurality of individual playing cards, and each of the individual playing cards have a face suit including one of Hearts, Diamonds, Clubs and Spades, and an associated face value including one of Ace, two, three, four, five, six, seven, eight, nine, ten, Jack, Queen and King. The pull-tab poker variant card game includes a set of rules for the card game. The rules include displaying images of backs of the five playing card images associated with the at least one ticket on the video display; placing an original wager before any card images on the at least one ticket are revealed on the display by using the input device; revealing three card images to the player and not revealing two hole-card images; giving the player the opportunity to increase their wager by a first amount after the player looks at their first three card images and before the two hole-card images are revealed; the player choosing to reveal a first hole-card image on the display by using the input device; giving the player the opportunity to increase their wager by a second amount after the player looks at the first hole card image before a second hole-card image is revealed; and revealing the second hole-card image on the display by using the input device and paying a player having a winning hand for the total wager including the original wager and the first amount, if applicable, based upon a predetermined payout table that indicates what hands are winning hands.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings:

FIG. 6 is a payout table that indicates what hands are winning hands in accordance with preferred embodiments of the present invention.

DETAILED DESCRIPTION OF THE INVENTION

Figure 1:
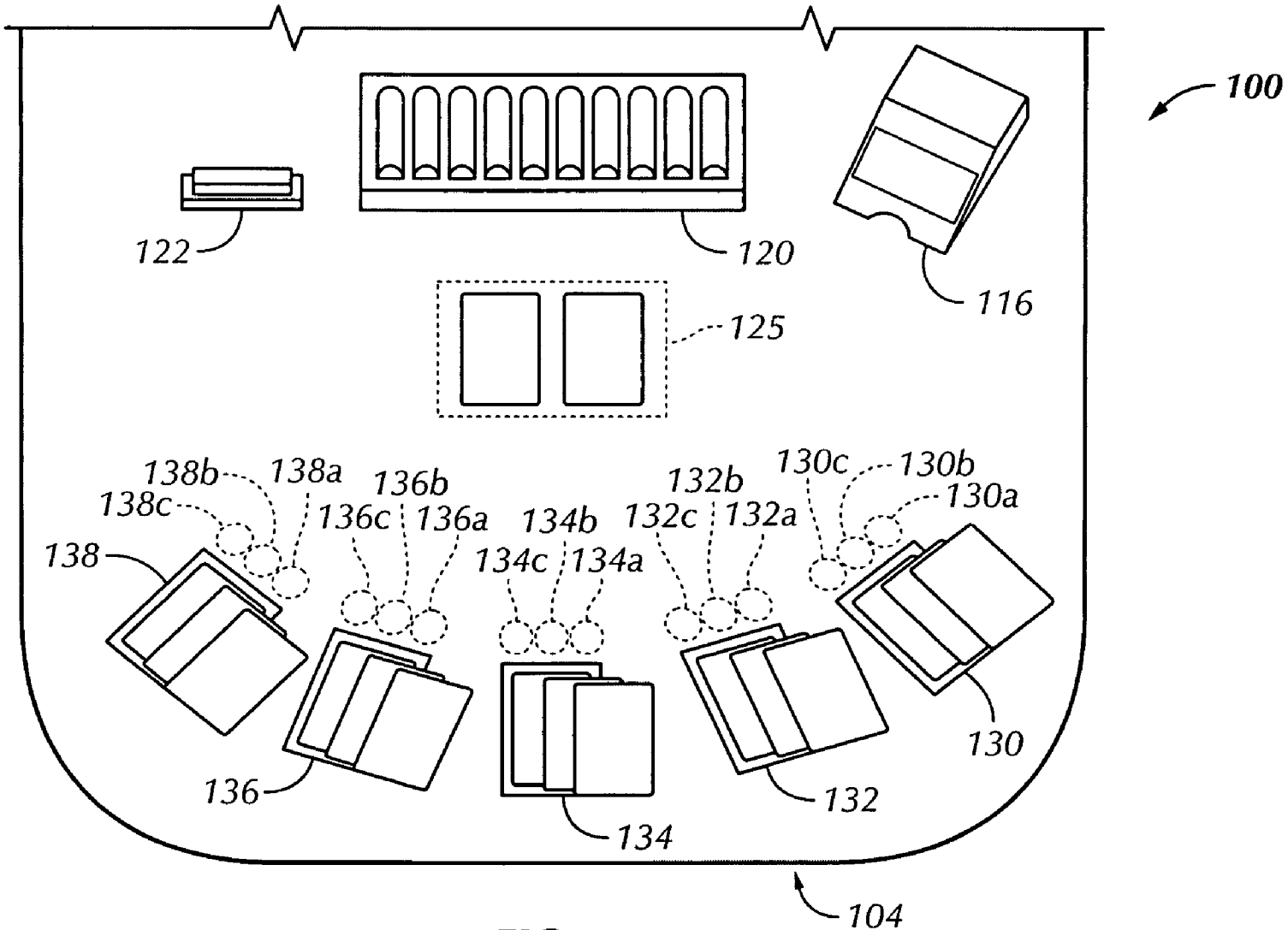
FIG. 1 is a playing area for a variant card game in accordance with preferred embodiments of the present invention.

Certain terminology is used in the following description for convenience only and should not be construed as limiting. The word "a" as used in the claims and in the corresponding portions of the Specification, means "one or more than one." In the drawings, the same reference numerals are employed for designating the same elements throughout the figures.

Figure 2:
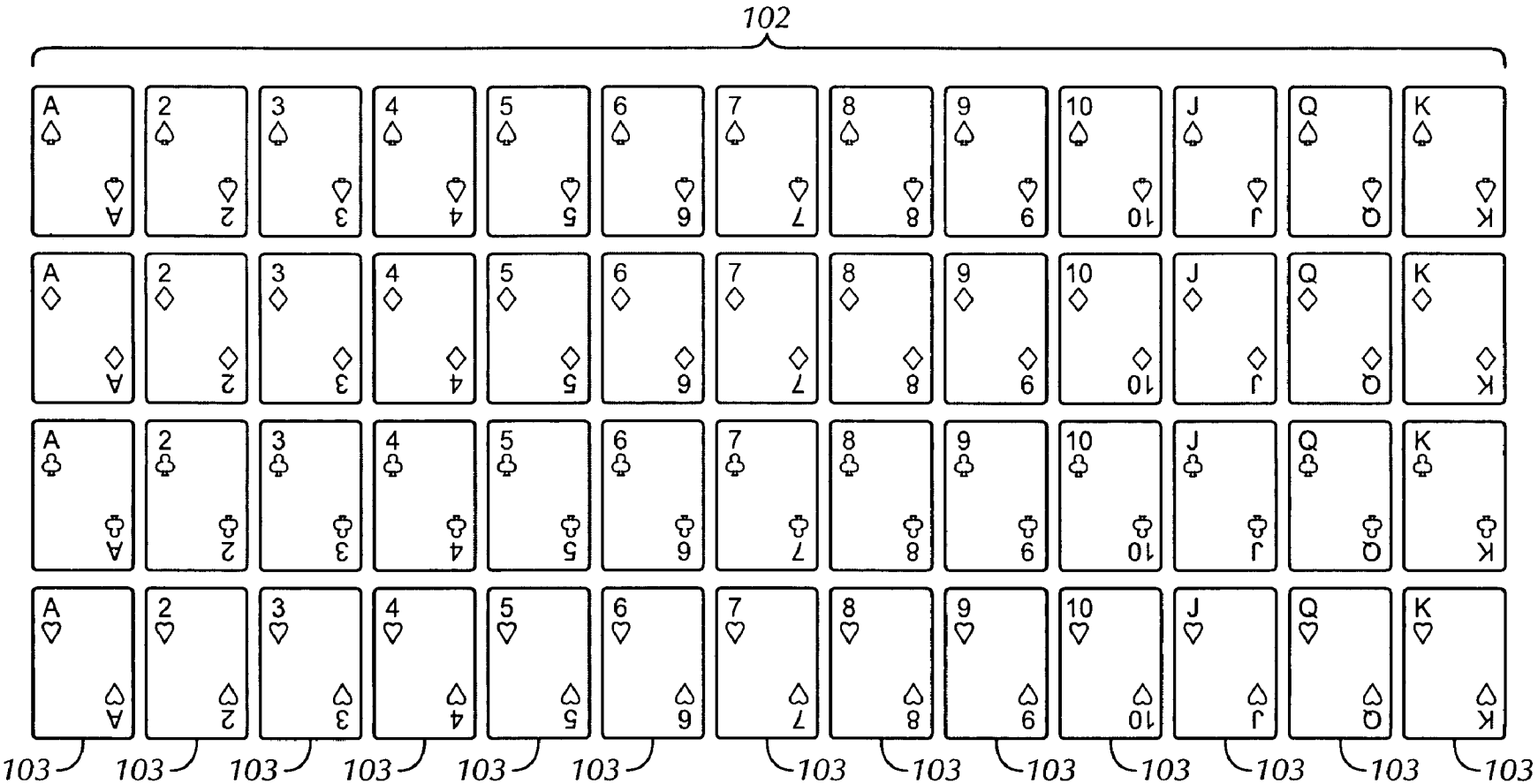
FIG. 2 shows playing cards for a conventional deck of cards.

Referring to the drawings in detail, FIG. 1 shows a playing area 104 and FIG. 2 shows a conventional deck 102 of playing cards 103. The conventional deck 102 of playing cards 103 each have a plurality of individual playing cards 103. Preferably, the deck 102 of cards 103 is a conventional deck of cards comprising fifty-two cards. FIG. 2 shows that each of the individual playing cards 103 has a face suit including one of Hearts, Diamonds, Clubs and Spades, and an associated face value including one of two "2", three "3", four "4", five "5", six "6", seven "7", eight "8", nine "9", ten "10", Jack "J", Queen "Q", and King "K" and Ace "A". The poker game 100 further includes a shoe 116 configured to accept cards 103 of the deck or decks 102 for dealing during play. The shoe 116 is disposed proximate to or within the playing area 104 (FIG. 1), nearest the dealer position.

Figure 4:
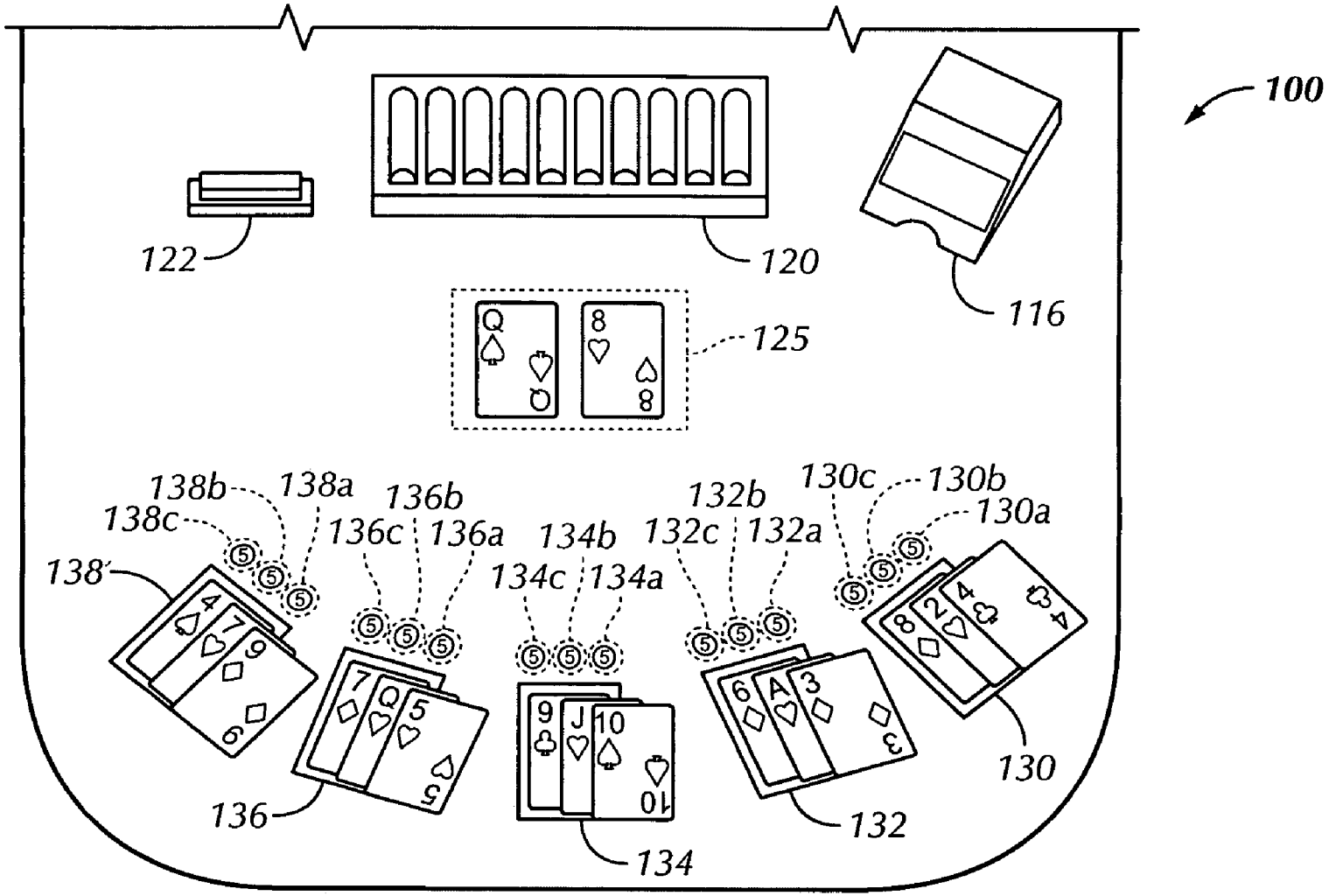
FIG. 4 is a poker variant card game in accordance with a first preferred embodiment of the present invention.

FIG. 4 depicts the poker variant card game 100 playable in accordance with a first preferred embodiment of the present invention. The poker variant card game 100 includes the one or more conventional decks 102 of cards 103 and a set of rules for the card game 100. Each of the one or more conventional decks 102 of cards 103 has a plurality of individual playing cards 103. Each of the individual playing cards 103 has a back, a face, a face suit including one of Hearts, Diamonds, Clubs and Spades, and an associated face value including one of Ace, two, three, four, five, six, seven, eight, nine, ten, Jack, Queen and King. Preferably, there are regions 130, 132, 134, 136 and 138 on the playing area 104 for dealing cards 103 to individual players (not shown).

Preferably, the poker variant card game 100 is a variation of five card stud poker, wherein each player places a wager before the cards are dealt. In a variation of five card stud poker with press it up wagering, the players are only given the opportunity to increase wagers and not to pull back wagers in contrast to games like Let-It-Ride Poker. Thus, in lieu of giving the option of withdrawing a wager after cards 103 are dealt and/or after a hole-card 125 is turned over, at each step the player is instead given the option to increase their preexisting original wager 130*a*, 132*a*, 134*a*, 136*a*, 138*a* or one of a plurality of wagers 130*a*-130*c*, 132*a*-132*c*, 134*a*-134*c*, 136*a*-136*c*, 138*a*-138*c*, such as being able to double their wager 130*a*, 132*a*, 134*a*, 136*a*, 138*a* or one of a plurality of wagers 130*a*-130*c*, 132*a*-132*c*, 134*a*-134*c*, 136*a*-136*c*, 138*a*-138*c* after some event takes place.

The rules include each player placing an original wager 130*a*, 132*a*, 134*a*, 136*a*, 138*a* before any cards 103 are dealt; dealing three cards 103 to each player face down and two hole-cards face down 125 (FIG. 1); giving each player the opportunity to increase their wager 130*a*, 132*a*, 134*a*, 136*a*, 138*a* by a first amount after they look at their first three cards 103 before any hole-cards 125 are revealed; revealing the first hole-card 103 and giving each player an opportunity to increase their wager 130*a*, 132*a*, 134*a*, 136*a*, 138*a* by a second amount; revealing the second hole-card 125; and paying each player having a winning hand for their total respective wager including their respective original wager 130*a*, 132*a*, 134*a*, 136*a*, 138*a* and their respective first and second amount, if applicable, based upon a predetermined payout table P that indicates what hands are winning hands. While explained in a multi-player environment typical in a casino, the game 100 is really played against the house based upon the predetermined payout table P.

FIG. 6 is a payout table P that indicates what hands are winning hands in accordance with preferred embodiments of the present invention. Other payout ratios for winning hands can be utilized without departing from the present invention.

Alternatively, the rules include each player placing an original wager 130*a*, 132*a*, 134*a*, 136*a*, 138*a* before any cards 103 are dealt; dealing two cards 103 to each player face down and five hole-cards 103 face down; giving each player the opportunity to increase their wager 130*a*, 132*a*, 134*a*, 136*a*,

138*a* by a first amount after they look at their first two cards 103 before any hole-cards 103 are revealed; revealing first, second and third hole-cards and giving each player an opportunity to increase their wager 130*a*, 132*a*, 134*a*, 136*a*, 138*a* by a second amount; revealing a fourth hole-card and giving each player an opportunity to increase their wager 130*a*, 132*a*, 134*a*, 136*a*, 138*a* by a third amount; revealing a fifth hole-card; and paying each player having a winning hand for their total respective wager 130*a*, 132*a*, 134*a*, 136*a*, 138*a* including their respective original wager 130*a*, 132*a*, 134*a*, 136*a*, 138*a* and their respective first, second and third amounts, if applicable, based upon a predetermined payout table P that indicates what hands are winning hands.

Alternatively, the rules include each player placing first and second wagers 130*a*-130*b*, 132*a*-132*b*, 134*a*-134*b*, 136*a*-136*b*, 138*a*-138*b* before any cards are dealt; dealing three cards to each player face down and two hole-cards 125 face down; giving each player the opportunity to increase their first wager 130*a*, 132*a*, 134*a*, 136*a*, 138*a* by a first amount after they look at their first three cards 103 before any hole-cards 125 are revealed; revealing the first hole-card 125 and giving each player an opportunity to increase their second wager 130*b*, 132*b*, 134*b*, 136*b*, 138*b* by a second amount; revealing the second hole-card 125; and paying each player having a winning hand for all of their respective wagers including their respective first and second wagers 130*a*-130*b*, 132*a*-132*b*, 134*a*-134*b*, 136*a*-136*b*, 138*a*-138*b* and their respective first and second amount, if applicable, based upon a predetermined payout table P that indicates what hands are winning hands. Thus, in a table version of the poker variant card game 100, a dealer deals the cards 103 and pays out winning hands based upon the payout table P (FIG. 6) that indicates what hands are winning hands.

Alternatively, the rules include each player placing an original wager 130*a*, 132*a*, 134*a*, 136*a*, 138*a* before any cards 103 are dealt. Then five cards 103 are dealt to each player face down. Each player is given the opportunity to increase their wager by a first amount after they look at their first five cards 103. If the player increases their wager 130*a*, 132*a*, 134*a*, 136*a*, 138*a* by the first amount, the respective player is dealt a sixth card and that player is given an opportunity to increase their wager 130*a*, 132*a*, 134*a*, 136*a*, 138*a* by a second amount after they look at their sixth card 103. If the player increases their wager 130*a*, 132*a*, 134*a*, 136*a*, 138*a* by the second amount, the respective player is dealt a seventh card 103. Each player having a winning hand is paid for their total respective wager including their respective original wager 130*a*, 132*a*, 134*a*, 136*a*, 138*a* and their respective first and second amounts, if applicable, based upon a predetermined payout table P that indicates what hands are winning hands.

Preferably, the first and second amounts are each less than or equal to the respective player's original wager. Thus, the player can in effect "double" their original wager and then "triple" their original wager.

Alternatively, the rules include each player placing first, second and third wagers 130*a*-130*c*, 132*a*-132*c*, 134*a*-134*c*, 136*a*-136*c*, 138*a*-138*c* before any cards are dealt; dealing two cards to each player face down and three hole-cards 125 face down; giving each player the opportunity to increase their first wager 130*a*, 132*a*, 134*a*, 136*a*, 138*a* by a first amount after they look at their first three cards 103 before any hole-cards 125 are revealed; revealing the first hole-card 125 and giving each player an opportunity to increase their second wager 130*b*, 132*b*, 134*b*, 136*b*, 138*b* by a second amount; revealing the second hole-card 125 and giving each player an opportunity to increase their third wager 130*c*, 132*c*, 134*c*, 136*c*, 138*c* by a third amount; revealing the third hole-card 125; and paying each player having a winning hand for all of their respective wagers including their respective first and second wagers 130*a*-130*b*, 132*a*-132*b*, 134*a*-134*b*, 136*a*-136*b*, 138*a*-138*b* and their respective first and second amount, if applicable, based upon a predetermined payout table P that indicates what hands are winning hands. Thus, in a table version of the poker variant card game 100, a dealer deals the cards 103 and pays out winning hands based upon the payout table P (FIG. 6) that indicates what hands are winning hands.

The card game 100 may also be implemented as an electronic card game 100 playable in an amusement or gaming device 14 (FIG. 5), such as a touchscreen amusement or gaming device 14 having a display 37. The electronic card game may be playable in a personal computer, via the Internet by way of a web browser, in a personal digital assistant (PDA), in a hand-held portable game unit such as a Nintendo Game-Boy®, available from Nintendo of America Inc., Redmond, Wash., in a video game console such as a Nintendo GameCube®, also available from Nintendo of America Inc., in a cellular telephone or another dedicated device.

The card game 100 may be playable against other people or by an individual player. The game 100 need not be a player against the dealer game. The player can simply wager on a single set of five cards 103 wherein some portion of the cards are revealed to the player after placing the original wager (e.g., three of five) and the rest are hole-cards 125 that are revealed to the player one at a time (e.g., two of five). The hole-cards 125 are used in combination with the cards 103 dealt directly to the player to form a player's hand. Any combination of immediately revealed cards 103 and hole-cards 125 can be used to change the number of wager increases (e.g., 1 immediately revealed and 4 hole-cards, 2 immediately revealed and 3 hole-cards, 3 immediately revealed and 2 hole-cards and 4 immediately revealed and 1 hole-card).

Figures 3A, 3B:
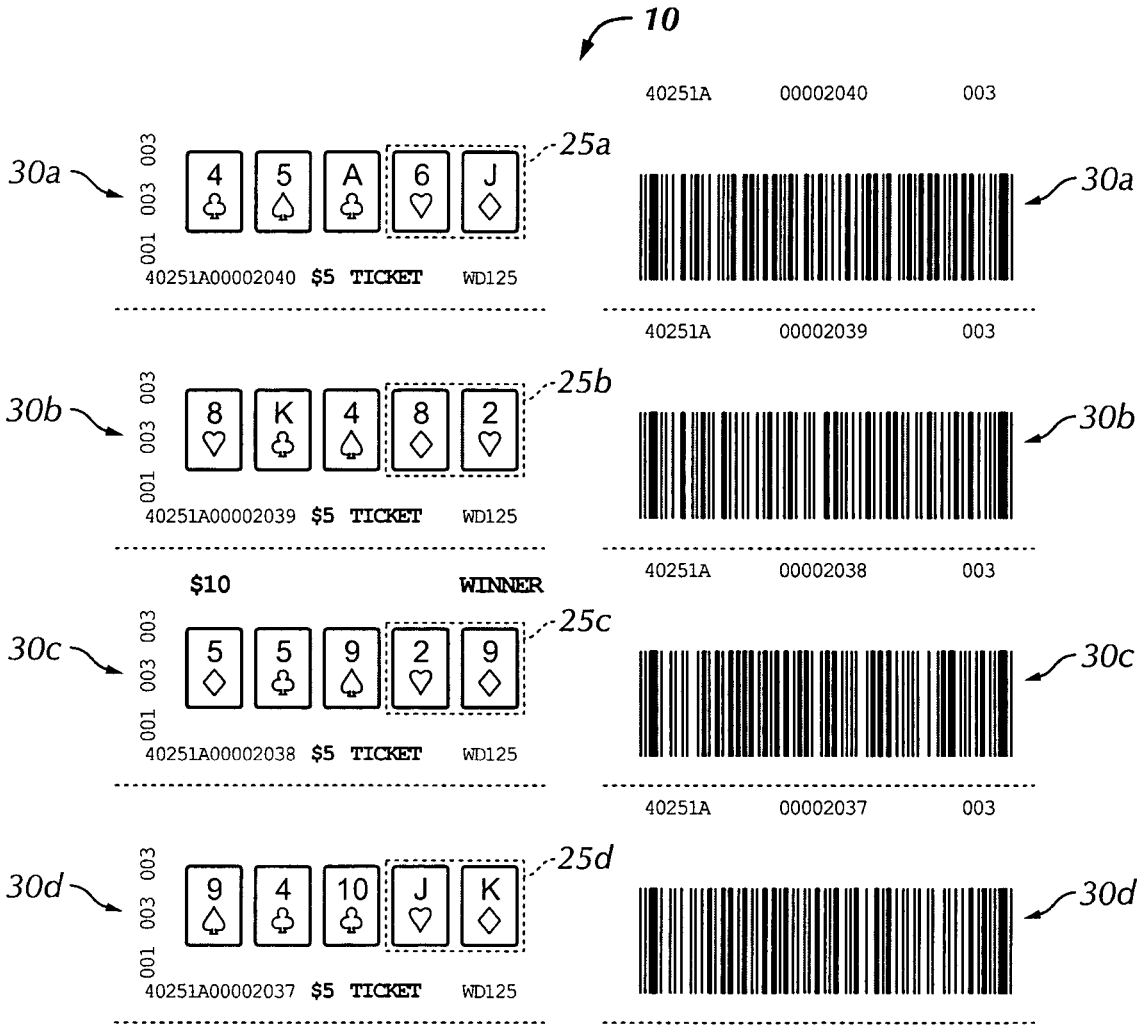
FIG. 3A depicts a front view of a strip of pull-tab tickets with the pull-tabs removed.
FIG. 3B depicts a rear view of the strip of pull-tab tickets of FIG. 3A.

In a second preferred embodiment, the game 10 can be implemented using paper or video pull-tab ticket 30*a*-30*d* (FIG. 3). Paper pull-tab tickets are typically two-ply laminated paper pull-tab ticket 30*a*-30*d* that contain perforated windows which conceal various game symbols, numbers, etc. The front of a paper pull-tab ticket 30*a*-30*d* typically shows the name of the game, the cost of a ticket, the winning symbol combinations, the prize values, and the overall odds of winning a prize. The back of the paper pull-tab ticket 30*a*-30*d* typically has perforated windows that open to reveal the game symbols. Under each window are winning and losing symbols.

Figure 5:
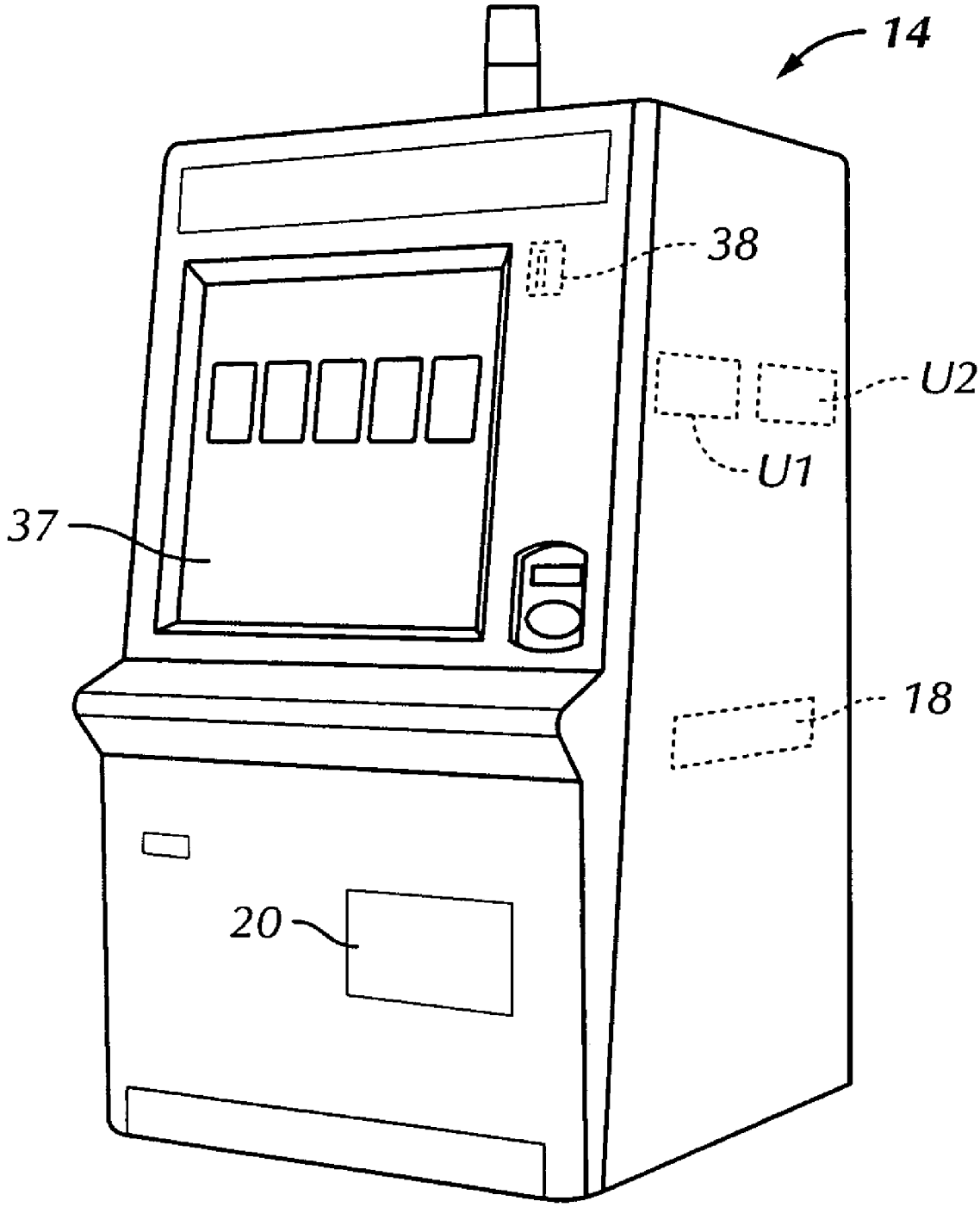
FIG. 5 is a perspective view of an electronic gaming or amusement device for implementing a second preferred embodiment of the present invention.

Video pull-tabs are an electronic implementation of the paper pull-tab tickets 30*a*-30*d*. FIG. 5 shows an amusement device or gaming machine 14 for playing pull-tab poker variant card game 10 that includes a video display 37, an input device 37 that receives player input (also 37) and a ticket 30*a*-30*d* having five images 25*a*-25*d* of playing cards selected from a conventional deck 102 of cards 103. The input device 37 is preferably a touchscreen which is integrally associated with the video display 37. Alternatively, the input device 37 may be one or more buttons, a keypad, a joystick, a trackball and the like. The gaming machine 14 includes a controller U1 and a memory U2. The controller U1 runs a control program for graphics and input/output (I/O) control stored in the memory U2. The video display/touchscreen 37 preferably displays graphics in addition to the ticket images including advertisements, total credits accumulated, game rules and help screens and the like. Optionally, the gaming machine 14 includes a ticket reader 18 for reading what images 25*a*-25*d* are contained on a pre-printed ticket 30*a*-

30*d*. Optionally, the gaming machine 14 includes a ticket dispenser 20 that physically dispenses the ticket 30*a*-30*d* after all of the images 25*a*-25*d* have been revealed. Optionally, the gaming machine 14 includes a currency input device 38 which may be a coin acceptor, a token acceptor, a bill acceptor, a card reader and the like.

Playing the electronic pull-tab game 10 is done on the electronic gaming machine 14 by selecting a "pull-tab window" to open (e.g., by touching a card image region on the display 37). The gaming machine 14 may include a plurality of different kinds of pull-tab games 10 such as variations of five-card stud and seven-card stud. When the gaming machine 14 includes physical tickets 30*a*-30*d*, there may be a plurality of reels or rolls of tickets 30*a*-30*d* which are selectively accessed and dispensed depending on the player selected game 10. A player chooses a game 10 by touching the display screen (touchscreen) 37, a soft-key or a physical button associated with the name of the game 10. Once in the game 10, a player chooses the amount they wish to wager by touching a wager field, soft-key or physical button on or near the display screen 37. The images on the screen 37 are typically covered by solid tabs or images of the backs of playing cards that can be opened by touching them or a button associated with them. The rules include displaying images of backs of the five playing card images 25*a*-25*d* associated with the ticket 30*a*-30*d* on the video display 37 (i.e., depicted as rectangles on the display 37 of FIG. 5); placing an original wager before any card images 25*a*-25*d* on the ticket 30*a*-30*d* are revealed on the display 37 by using the input device 37; revealing three card images 25*a*-25*d* to the player and not revealing two hole-card images 25*a*-25*d*; giving the player the opportunity to increase their wager by a first amount after the player looks at their first three card images 25*a*-25*d* and before the two hole-card images 25*a*-25*d* are revealed; the player choosing to reveal a first hole-card image 25*a*-25*d* on the display by using the input device 37; giving the player the opportunity to increase their wager by a second amount after the player looks at the first hole card image 25*a*-25*d* before a second hole-card image 25*a*-25*d* is revealed; and revealing the second hole-card image 25*a*-25*d* on the display 37 and paying a player having a winning hand for the total wager including the original wager and the first amount, if applicable, based upon a predetermined payout table P that indicates what hands are winning hands. When a player wins, an indication will be displayed across the images 25*a*-25*d* and the winnings are either dispensed or posted to their accumulated credits. The player may be able to redeem credits locally at the game machine 14, the player may have to request a payout ticket from the game machine 14 (e.g., a printed receipt with coding), the player may have a magnetic stripe card that tracks credits or the player may have to take physically dispensed winning pull-tab tickets 30*a*-30*d* to a cashier or attendant.

The pull-tab poker variant card game 10 includes a pull-tab ticket 30*a*-30*d* and a set of rules for the card game 10. The pull-tab ticket 30 has five images of playing cards 103 (i.e., indicia representative of playing cards) selected from a conventional deck 102 of cards 103. There may be tabs or scratch-off material covering the five images of playing cards 103. The conventional deck 102 of cards 103 has a plurality of individual playing cards 103. Each of the individual playing cards 103 has a face suit and value as described above. The rules include placing an original wager before any card images are revealed on the ticket 30*a*-30*d*; revealing three card images to the player and not revealing two hole-card images 25*a*-25*d*; giving the player the opportunity to increase their wager by a first amount after they look at their first three card images before any hole-card images 25*a*-25*d* are revealed; revealing the first hole-card image 25*a*-25*d* and giving the player an opportunity to increase their wager by a second amount; revealing the second hole-card image 25*a*-25*d*; and paying a player having a winning hand for the total wager including the original wager and the first and second amounts, if applicable, based upon a predetermined payout table P that indicates what hands are winning hands.

In an alternate embodiment, the rules include placing an original wager before any card images are revealed on the ticket; revealing two card images to the player and not revealing three hole-card images 25*a*-25*d*; giving the player the opportunity to increase their wager by a first amount after they look at their first two card images before any hole-card images 25*a*-25*d* are revealed; revealing a first hole-card image 25*a*-25*d* and giving the player an opportunity to increase their wager by a second amount; revealing a second hole-card image 25*a*-25*d* and giving the player an opportunity to increase their wager by a third amount; revealing a third hole-card image 25*a*-25*d*; and paying a player having a winning hand for the total wager including the original wager and the first, second and third amounts, if applicable, based upon a predetermined payout table P that indicates what hands are winning hands.

In another alternate embodiment, the rules include placing an original wager before any card images are revealed on the ticket; revealing four card images to the player and not revealing a hole-card image 25*a*-25*d*; giving the player the opportunity to increase their wager by a first amount after they look at their first four card images before the hole-card image 25*a*-25*d* is revealed; revealing the hole-card image 25*a*-25*d*; and paying a player having a winning hand for the total wager including the original wager and the first amount, if applicable, based upon a predetermined payout table P that indicates what hands are winning hands.

Due to state or federal gaming regulations, the video pull-tab gaming machines 14 may be required to include a dispenser 20 that releases one physical pull-tab ticket 30*a*-30*d* at a time off a roll contained inside the gaming machine 14. When using a pull-tab dispensing machine such as the Lucky Tab II machine, the scanner or reader 18 reads the back of the ticket 30*a*-30*d* as it is dispensed and displays the contents of the ticket 30*a*-30*d* on the video monitor 37. For control and regulation purposes, a cashier redeems all winning pull-tab tickets 30*a*-30*d*. The element of chance is contained entirely in the finite deal of pull-tab tickets 30*a*-30*d*.

In another alternate embodiment, a pull-tab poker variant card game 10 includes a ticket 30*a*-30*d* having seven images of playing cards selected from a conventional deck 102 of cards 103 and a set of rules for the card game 10. The rules include placing an original wager before any card images 25*a*-25*d* are revealed on the ticket 30*a*-30*d*; revealing two card images 25*a*-25*d* and not revealing five hole-card images 25*a*-25*d*; giving each player the opportunity to increase their wager by a first amount after they look at their first two card images 25*a*-25*d* before any hole-card images 25*a*-25*d* are revealed. First, second and third hole-card images 25*a*-25*d* are revealed and the player is given an opportunity to increase their wager by a second amount. A fourth hole-card image 25*a*-25*d* is revealed and the player giving each player an opportunity to increase their wager by a third amount. Finally, a fifth hole-card image 25*a*-25*d* is revealed and each player having a winning hand is paid for their total respective wager including their respective original wager and their respective first, second, third, fourth and fifth amounts, if applicable, based upon a predetermined payout table P that indicates what hands are winning hands.

In another alternate embodiment, a pull-tab poker variant card game 10 includes a ticket 30*a*-30*d* having seven images of playing cards selected from a conventional deck 102 of cards 103 and a set of rules for the card game 10. The rules include placing an original wager before any card images 25*a*-25*d* are revealed on the ticket; revealing five card images 25*a*-25*d* to the player. The player is given the opportunity to increase their wager by a first amount after they look at their first five card images 25*a*-25*d*. If the player increases their wager by the first amount, a sixth card image 25*a*-25*d* is revealed and that player is given an opportunity to increase their wager by a second amount after they look at their sixth card image 25*a*-25*d*. If the player increases their wager by the second amount, a seventh card image 25*a*-25*d* is revealed. A player having a winning hand is paid for the total wager including the original wager and the first and second amounts, if applicable, based upon a predetermined payout table P that indicates what hands are winning hands.

Alternatively, the pull-tab tickets 30*a*-30*d* can be created by a random number generator in the controller U1 within the gaming machine 14, and therefore, no physical pull-tab tickets 30*a*-30*d* actually exist. Thus, the pull-tab ticket 30*a*-30*d* is virtual based on a randomly generated group of playing card images. In that case, the player may be able to redeem credits locally at the game machine 14, the player may have to request a payout ticket from the game machine 14, or the player may have a magnetic stripe card that tracks credits. In a random generator enabled gaming machine 14, a much larger variety of games 10 can be incorporated into one gaming machine 14 without the need to have physical tickets 30*a*-30*d*, the dispenser 20 and reader 18.

Alternatively, the pull-tab tickets 30*a*-30*d* may be stored as a predetermined file, encrypted or not, in the memory U2 such as a compact disc (CD), a hard-disc, flash memory and the like. The pull-tab tickets 30*a*-30*d* may not even be readable other than through the display 37 of the gaming machine 14 or by an accounting software.

Alternatively, the pull-tab tickets 30*a*-30*d* can be played straight off a roll or out of a box without the use of the dispenser 20. In this case, the player would need to go to an attendant or cashier to have the ticket punched, marked or stamped to indicate that the player has placed an increased wager amount before each step in the rules as described above.

It is also contemplated that the players could just as easily sit around a table with an attendant situated like a dealer in conventional table-based card games to take increased wagers before each step in the rules as described above and to sell new physical pull-tab tickets 30*a*-30*d*.

Optionally, when a player redeems winning pull-tab tickets 30*a*-30*d* that are physically dispensed, a record of the redemption is made at a remote database and the pull-tab ticket 30*a*-30*d* is preferably marked or defaced in some manner by a ticket marker 18 as it is being dispensed by the gaming machine 14 to indicate to the player and attendants that the pull-tab ticket 30*a*-30*d* was redeemed. The pull-tab ticket 30*a*-30*d* is also preferably marked in some manner to indicate its base value (i.e., the original wager amount). When using the present invention with various press-it-up wagering schemes, the value of a winning pull-tab ticket 30*a*-30*d* is not always instantly known since it depends upon the increased amount that is wagered by the player and the original wager amount if that amount is selectable by the player. Accordingly, indicia can be printed or marked on the dispensed pull-tab ticket 30*a*-30*d* so that the player and cashier can immediately recognize the winning amount. Of course, when redeeming the pull-tab ticket 30*a*-30*d* at a cashier, the bar code is still read and used to verify that the pull-tab ticket 30*a*-30*d* is a winner. The indicia may be used to check the winning amount stored in the database. The indicia may be a printed amount of the ticket value in dollars or credits, or it may be marks, holes or the like that indicate the number of credits played (e.g., 1, 2 or 3 marks depending upon whether 1, 2 or 3 credits were played). If the original wager amount is player-selectable, then the indicia would also indicate that value. In sum, the ticket marker 18 causes some form of an indicator to appear on the dispensed pull-tab ticket 30*a*-30*d*. Some ways of indicating include, but are not limited to, printing/marking, stamping, cutting, and embossing. To summarize, the ticket marker 18 is used to indicate the amount of the original wager, increased wager amounts, as well as to mark redeemed pull-tab tickets 30*a*-30*d*.

Optionally, the video version of the poker game 100 is configured as a gaming system including a network of game machines that are all linked to a server (not shown) which provides an accounting system with audit capabilities. Preferably, the server also handles all accounting and reconcilement functions as well as daily and weekly revenue reports for a particular establishment. The gaming system allows an establishment to assign a specific identification to each player to track behaviors and preferences while recording player history. The establishment can use this history to reward player activity with gifts and prizes and to build databases for use in direct mail and marketing events.

Optionally, there may be a separate progressive jackpot for each game/deal in play (e.g., $1 Poker). The progressive jackpot is accumulated until a predetermined winning hand is attained by a player such as a royal flush.

In alternative embodiments, a cash only payment system may be used, or a ticket-based system may be used similar to the EZ-Pay™ Ticket System, available from International Game Technology, Reno, Nev. The EZ-Pay system is generally described in U.S. Pat. No. 6,676,522 (Rowe et al.), incorporated herein by reference. U.S. Pat. No. 6,048,269 (Burns et al), incorporated herein by reference, also shows a cashless/coinless slot machine system similar to the EZ-Pay system and which may be used as a payment system for the present invention.

The tickets used in the present invention may be dispensed from a continuous roll or sheet, or they may be printed on separate sheets of printed media and dispensed from a stack.

The present invention may be implemented with any combination of hardware and software. If implemented as a computer-implemented apparatus, the present invention is implemented using means for performing all of the steps and functions described above.

From the foregoing, it can been seen that the present inventions comprises card game and method of playing a card game, and more particularly, to a variant poker game including a wagering scheme therefor. It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A pull-tab poker variant card game comprising:

(a) at least one ticket having five images of playing cards selected from a conventional deck of cards, the conventional deck of cards having a plurality of individual playing cards, each of the individual playing cards having a face suit including one of Hearts, Diamonds, Clubs and Spades, and an associated face value including one of Ace, two, three, four, five, six, seven, eight, nine, ten, Jack, Queen and King; and (b) a set of rules for the card game, the rules including:

(i) placing an original wager by a player before any card images are revealed on the at least one ticket, the original wager being placed by one of an indication to an attendant and deposition of currency with a gaming machine containing the at least one ticket;

(ii) giving the player an opportunity to increase their wager by a first amount, by one of an indication to the attendant and deposition of currency with the gaming machine, after revealing three card images to the player and not revealing two hole-card images, the three card images being revealed by one of removal of a cover of each of the card images from the at least one ticket and reading, by the gaming machine, of indicia on the at least one ticket indicative of the three card images, the hole-card images being unique to the respective at least one ticket;

(iii) giving the player an opportunity to increase their wager by a second amount, by one of an indication to the attendant and deposition of currency with the gaming machine, after revealing a first hole card image, the first hole-card image being revealed by one of removal of a cover of the first hole-card image from the at least one ticket and reading, by the gaming machine, of indicia on the at least one ticket indicative of the first hole-card image;

(iv) revealing a second hole-card image by one of removal of a cover of the second hole-card image from the at least one ticket and reading, by the gaming machine, of indicia on the at least one ticket indicative of the second hole-card image; and (v) paying a player having a winning hand for the total wager including the original wager and the first and second amounts, if applicable, based upon a predetermined payout table that indicates what hands are winning hands, payment being made to the winning player by one of the attendant and the gaming machine.

2. The pull-tab poker variant card game of claim 1, wherein the first amount is less than or equal to the respective player's original wager.

3. The pull-tab poker variant card game of claim 2, wherein the second amount is less than or equal to the respective player's original wager.

4. The pull-tab poker variant card game of claim 1, wherein the game is implemented as one of a table game and a manually dispensed ticket game.

5. The pull-tab poker variant card game of claim 1, wherein the at least one ticket is physically dispensed to the player upon completion of playing that hand.

6. A pull-tab poker variant card game comprising:

(a) at least one ticket having five images of playing cards selected from a conventional deck of cards, the conventional deck of cards having a plurality of individual playing cards, each of the individual playing cards having a face suit including one of Hearts, Diamonds, Clubs and Spades, and an associated face value including one of Ace, two, three, four, five, six, seven, eight, nine, ten, Jack, Queen and King; and (b) a set of rules for the card game, the rules including:

(i) placing an original wager by a player before any card images are revealed on the at least one ticket, the original wager being placed by one of an indication to an attendant and deposition of currency with a gaming machine containing the at least one ticket;

(ii) giving the player an opportunity to increase their wager by a first amount, by one of an indication to the attendant and deposition of currency with the gaming machine, after revealing two card images to the player and not revealing three hole-card images, the two card images being revealed by one of removal of a cover of each of the card images from the at least one ticket and reading, by the gaming machine, of indicia on the at least one ticket indicative of the two card images, the hole-card images being unique to the respective at least one ticket;

(iii) giving the player an opportunity to increase their wager by a second amount, by one of an indication to the attendant and deposition of currency with the gaming machine, after revealing a first hole-card image, the first hole-card image being revealed by one of removal of a cover of the first hole-card image from the at least one ticket and reading, by the gaming machine, of indicia on the at least one ticket indicative of the first hole-card image;

(iv) giving the player an opportunity to increase their wager by a third amount, by one of an indication to the attendant and deposition of currency with the gaming machine, after revealing a second hole card image, the second hole-card image being revealed by one of removal of a cover of the second hole-card image from the at least one ticket and reading, by the gaming machine, of indicia on the at least one ticket indicative of the second hole-card image;

(v) revealing a third hole-card image by one of removal of a cover of the third hole-card image from the at least one ticket and reading, by the gaming machine, of indicia on the at least one ticket indicative of the third hole-card image; and (vi) paying a player having a winning hand for the total wager including the original wager and the first, second and third amounts, if applicable, based upon a predetermined payout table that indicates what hands are winning hands, payment being made to the winning player by one of the attendant and the gaming machine.

7. The pull-tab poker variant card game of claim 6, wherein the first amount is less than or equal to the respective player's original wager.

8. The pull-tab poker variant card game of claim 7, wherein the second amount is less than or equal to the respective player's original wager.

9. The pull-tab poker variant card game of claim 6, wherein the game is implemented as one of a table game and a manually dispensed ticket game.

10. The pull-tab poker variant card game of claim 6, wherein the at least one ticket is physically dispensed to the player upon completion of playing that hand.

11. A pull-tab poker variant card game comprising:

(a) at least one ticket having seven images of playing cards selected from a conventional deck of cards, the conventional deck of cards having a plurality of individual playing cards, each of the individual playing cards having a face suit including one of Hearts, Diamonds, Clubs and Spades, and an associated face value including one of Ace, two, three, four, five, six, seven, eight, nine, ten, Jack, Queen and King; and (b) a set of rules for the card game, the rules including:

(i) placing an original wager by each player before any card images are revealed on the at least one ticket, each original wager being placed by one of an indication to an attendant and deposition of currency with a gaming machine containing the at least one ticket;

(ii) giving each player the opportunity to increase their wager by a first amount, by one of an indication to the attendant and deposition of currency with the gaming machine, after revealing two card images and not revealing five hole-card images, the two card images being revealed by one of removal of a cover of each of the card images from the at least one ticket and reading, by the gaming machine, of indicia on the at least one ticket indicative of the two card images, the hole-card images being unique to the respective at least one ticket;

(iii) giving each player an opportunity to increase their wager by a second amount, by one of an indication to the attendant and deposition of currency with the gaming machine, after revealing first, second, and third hole card images, the first, second, and third hole-card images being revealed by one of removal of a cover of each hole-card image from the at least one ticket and reading, by the gaming machine, of indicia on the at least one ticket indicative of the first, second, and third hole-card images;

(iv) giving each player an opportunity to increase their wager by a third amount, by one of an indication to the attendant and deposition of currency with the gaming machine, after revealing a fourth hole-card image, the fourth hole-card image being revealed by one of removal of a cover of the fourth hole-card image from the at least one ticket and reading, by the gaming machine, of indicia on the at least one ticket indicative of the fourth hole-card image;

(v) revealing a fifth hole-card image by one of removal of a cover of the fifth hole-card image from the at least one ticket and reading, by the gaming machine, of indicia on the at least one ticket indicative of the fifth hole-card image; and (vi) paying a player having a winning hand for their total respective wager including their respective original wager and their respective first, second and third amounts, if applicable, based upon a predetermined payout table that indicates what hands are winning hands, payment being made to the winning player by one of the attendant and the gaming machine.

12. The pull-tab poker variant card game of claim 11, wherein the first amount is less than or equal to the respective player's original wager.

13. The pull-tab poker variant card game of claim 12, wherein the second amount is less than or equal to the respective player's original wager.

14. The pull-tab poker variant card game of claim 11, wherein the game is implemented as one of a table game and a manually dispensed ticket game.

15. The pull-tab poker variant card game of claim 11, wherein the at least one ticket is physically dispensed to the player upon completion of playing that hand.

16. A gaming machine for playing a pull-tab poker variant card game comprising:

(a) a video display;

(b) an input device that receives player input;

(c) at least one ticket having five images of playing cards selected from a conventional deck of cards, the conventional deck of cards having a plurality of individual playing cards, each of the individual playing cards having a face suit including one of Hearts, Diamonds, Clubs and Spades, and an associated face value including one of Ace, two, three, four, five, six, seven, eight, nine, ten, Jack, Queen and King; and (d) a set of rules for the card game, the rules including:

(i) displaying images of backs of the five playing card images associated with the at least one ticket on the video display;

(ii) placing an original wager by a player before any card images on the at least one ticket are revealed on the display by using the input device, the original wager being placed by one of deposition of currency with the gaming machine or by an indication to the gaming machine using the input device;

(iii) giving the player the opportunity to increase their wager by a first amount, by one of deposition of currency with the gaming machine or by an indication to the gaming machine using the input device, after revealing three card images to the player and not revealing two hole-card images, the three card images being revealed by reading, by the gaming machine, of indicia on the at least one ticket indicative of the three card images, the hole-card images being unique to the respective at least one ticket;

(iv) giving the player the opportunity to increase their wager by a second amount, by one of deposition of currency with the gaming machine or by an indication to the gaming machine using the input device, after the player chooses to reveal a first hole-card image on the display, the first hole-card image being revealed by reading, by the gaming machine, of indicia on the at least one ticket indicative of the first hole-card image; and (v) revealing the second hole-card image on the display, the second hole-card image being revealed by reading, by the gaming machine, of indicia on the at least one ticket indicative of the second hole-card image, and paying a player having a winning hand for the total wager including the original wager and the first amount, if applicable, based upon a predetermined payout table that indicates what hands are winning hands, payment being made to the player by one of an attendant and the gaming machine.

17. The gaming machine for playing pull-tab poker variant card game according to claim 16, further comprising:

e) a ticket dispenser that physically dispenses the at least one ticket after all of the images have been revealed.

18. A pull-tab poker variant card game comprising:

(a) at least one ticket having seven images of playing cards selected from a conventional deck of cards, the conventional deck of cards having a plurality of individual playing cards, each of the individual playing cards having a face suit including one of Hearts, Diamonds, Clubs and Spades, and an associated face value including one of Ace, two, three, four, five, six, seven, eight, nine, ten, Jack, Queen and King; and (b) a set of rules for the card game, the rules including:

(i) placing an original wager by a player before any card images are revealed on the at least one ticket, the original wager being placed by one of an indication to an attendant and deposition of currency with a gaming machine containing the at least one ticket;

(ii) giving the player the opportunity to increase their wager by a first amount, by one of an indication to the attendant and deposition of currency with the gaming machine, after revealing five card images to the player, the five card images being revealed by one of removal of a cover of each of the card images from the at least one ticket and reading, by the gaming machine, of indicia on the at least one ticket indicative of the five card images;

(iii) only if the player increases their wager by the first amount, giving that player an opportunity to increase their wager by a second amount, by one of an indication to the attendant and deposition of currency with the gaming machine, after revealing a sixth card image, the sixth card image being revealed by one of removal of a cover of the sixth card image from the at least one ticket and reading, by the gaming machine, of indicia on the at least one ticket indicative of the sixth card image;

(iv) only if the player increases their wager by the second amount, revealing a seventh card image by one of removal of a cover of the seventh card image from the at least one ticket and reading, by the gaming machine, of indicia on the at least one ticket indicative of the seventh card image; and (v) paying a player having a winning hand for the total wager including the original wager and the first and second amounts, if applicable, based upon a predetermined payout table that indicates what hands are winning hands, payment being made to the winning player by one of the attendant and the gaming machine.

19. The pull-tab poker variant card game of claim 18, wherein the first amount is less than or equal to the respective player's original wager.

20. The pull-tab poker variant card game of claim 19, wherein the second amount is less than or equal to the respective player's original wager.

21. The pull-tab poker variant card game of claim 18, wherein the game is implemented as one of a table game and a manually dispensed ticket game.

22. The pull-tab poker variant card game of claim 18, wherein the at least one ticket is physically dispensed to the player upon completion of playing that hand.

* * * * *